United States Patent [19]

Coplin

[11] 4,120,607

[45] Oct. 17, 1978

[54] ROTOR BLADE FOR A GAS TURBINE ENGINE

[75] Inventor: John Frederick Coplin, Duffield, England

[73] Assignee: Rolls-Royce Limited, London, England

[21] Appl. No.: 778,170

[22] Filed: Mar. 16, 1977

[30] Foreign Application Priority Data

Mar. 26, 1976 [GB] United Kingdom ..... 12278/76

[51] Int. Cl.[2] ..... F01D 5/30

[52] U.S. Cl. ..... 416/2; 416/193 A; 416/212 A; 416/248

[58] Field of Search ..... 416/2, 193 A, 212 A, 416/219 R, 220 R, 234, 248

[56] References Cited

U.S. PATENT DOCUMENTS

| | | | |
|---|---|---|---|
| 2,867,408 | 1/1959 | Kolb et al. | 416/193 A X |
| 3,198,485 | 8/1965 | Melenchuk | 416/220 |
| 3,575,522 | 4/1971 | Melenchuk | 416/193 A |
| 3,871,791 | 3/1975 | Guy et al. | 416/193 A |
| 3,986,793 | 10/1976 | Warner et al. | 416/193 A X |

FOREIGN PATENT DOCUMENTS

| | | | |
|---|---|---|---|
| 1,204,858 | 8/1959 | France | 416/193 A |
| 21,142 | 4/1961 | German Democratic Rep. | 416/193 A |
| 313,027 | 4/1956 | Switzerland | 416/193 A |

*Primary Examiner*—Everette A. Powell, Jr.
*Attorney, Agent, or Firm*—Cushman, Darby & Cushman

[57] ABSTRACT

A rotor blade for a gas turbine engine comprises an aerofoil, an inner platform and a root portion. In order to restrain the movement of the blade should it become detached from its rotor, the platform has an indentation in that edge adjacent the convex flank. If the blade detaches, this indentation engages with the leading edge of the next adjacent blade in the row, tending to restrict motion of the detached blade to the radial plane.

7 Claims, 6 Drawing Figures

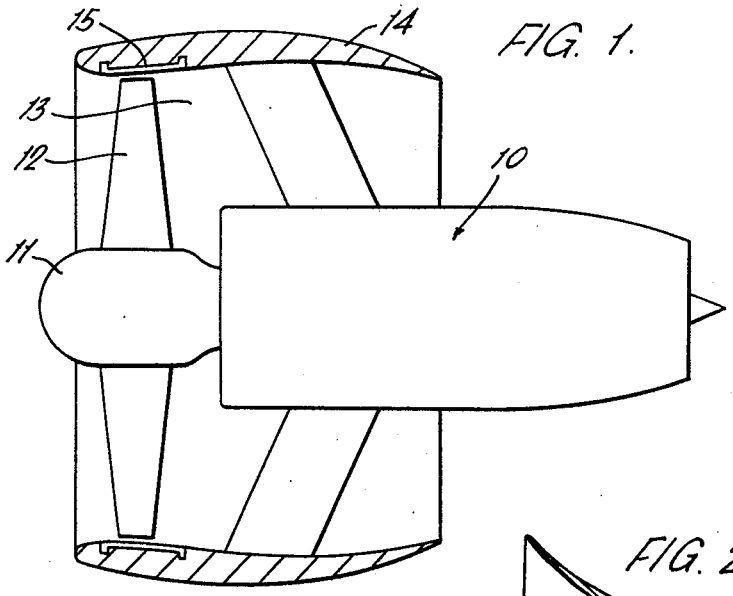
FIG. 1.
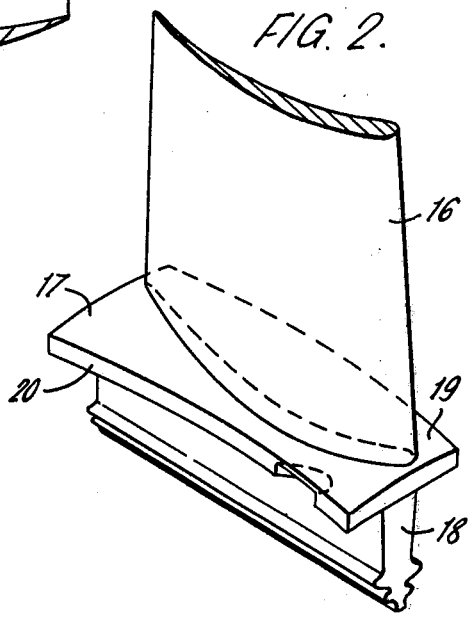
FIG. 2.
FIG. 3.
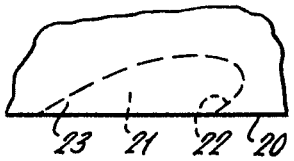
FIG. 4.
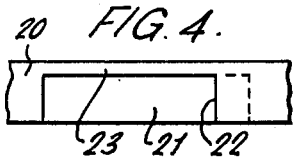
FIG. 5.
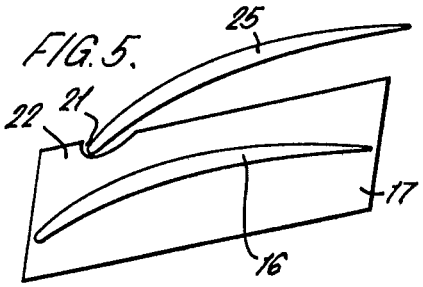
FIG. 6.
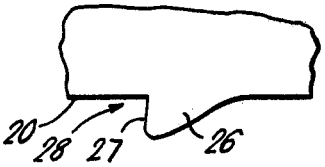

ROTOR BLADE FOR A GAS TURBINE ENGINE

This invention relates to a rotor blade for a gas turbine engine.

It has been necessary for designers of gas turbine engines to consider the possibility of the rotor blades, particularly fan blades, of a gas turbine engine becoming detached from their rotor, either because of the impact of a foreign body such as a bird, or because of failure of the root structure of the blade. Such failures normally result in a single blade being lost, this loose blade then causing damage to various other parts of an engine. Normally the most damaging of such failures involve the blade aerofoil and platform becoming detached from the root, or the complete blade becoming detached from the rotor.

It has been proposed in the past to surround those rotor stages which are most liable to such a failure with a strong ring which is able to withstand the impact of the loose rotor blade; however, through impact with the adjacent trailing blade these loose blades tend to be deflected rearwardly and there is a possibility that they might miss this strong ring.

The present invention relates to a construction of rotor blades in which the blade is modified so as to reduce this possibility.

According to the present invention, a rotor blade for a gas turbine engine comprises an aerofoil portion, an inner platform and a root portion, the inner platform being provided on that edge adjacent the convex flank of the aerofoil with an indentation adapted to engage with the leading edge of the next adjacent blade in a blade row should the aerofoil and platform become detached from its rotor.

The indentation may comprise a portion of said edge cut-away to form a hook, or it may comprise the junction between said edge and a projection from said edge.

Preferably the cut-away portion is not fully cut-away but comprises a frangible portion which covers the cut-away to maintain a smooth aerodynamic surface on the upper face of the platform.

We find that the best position for the indentation is in the leading half of the edge of the platform.

The invention will now be particularly described, merely by way of example with reference to the accompanying drawings in which:

FIG. 1 is a partly cut-away view of a gas turbine engine incorporating fan blades in accordance with the invention, FIG. 2 is a perspective view of the fan blade of FIG. 1, FIGS. 3 and 4 are enlarged top and side elevations of the cut-away portion of the platform of the FIG. 2 blade, FIG. 5 shows how the loose blade will engage with the next adjacent blade, and FIG. 6 is a view similar to FIG. 3 but of a further embodiment.

In FIG. 1 there is shown a gas turbine engine which comprises a core engine 10 which drives a fan rotor 11 carrying a plurality of rotor blades 12. The blades 12 operate within the duct 13 whose outer boundary is defined by the fan cowl 14. The internal structure of the core engine 10 is not shown in the drawing since it is not of importance to the present invention, but it will be understood by those skilled in the art that the core engine may comprise one of a number of forms of gas turbines which drives a fan turbine which in turn drives the fan. The fan operates to supercharge the core engine and to provide a by-pass flow of air in the duct 13 between the casing of the core engine and the fan cowl 14.

It will be appreciated that the fan blades 12 in the present instance comprise a single stage of relatively large blades and that the air entering the engine strikes these blades without there being any intervening stator structure. Although considerable care and ingenuity is exercised to minimise the likelihood of a fan blade becoming detached, absolute certainty cannot be achived and there is therefore a risk that one blade might detach from the rotor. Clearly when a fan blade becomes detached in this manner, its subsequent motion is mainly determined by releasing the centrifugal force acting on it, and it will therefore move substantially tangentially with a resulting radial component of motion outwards to strike the fan casing 14. It is therefore necessary to provide a strengthened annulus or containment ring 15 which forms part of the fan cowl and is made sufficiently strong to withstand the impact of the blade. If the blade moved exactly in a radial plane, the ring 15 could be relatively narrow, just covering the path of the rotor blades, but in prior art constructions the motion of the blade would have an additional component due to impact with the adjacent trailing blade which vigorously deflects the released blade root portion of the blade rearwards. Therefore, the motion of the blade would have an axial component in the rearwards direction of the gas flow of the engine and it was therefore necessary to provide a wider containment ring to cater for a secondary impact behind the plane of rotation of the fan. It should be noted that the worst impact occurs when a failed blade is released below the platform. Failures outboard of the platform produce a much less severe secondary impact, and need not be catered for to such a high degree.

The present invention provides a construction in which the excursion of the motion of the detached fan blade from the radial plane may be limited by its engagement with an adjacent blade which remains attached to the rotor. It will be seen from FIG. 2 that each fan blade 42 comprises an aerofoil portion 16, a platform 17 and a root portion 18 of reduced thickness relative to the platform at the point of attachment to the platform as best shown in FIG. 2. The platform 17 provides a smooth part-annular surface at the base of the aerofoil, and when the blades are assembled to the rotor, the edges 19 and 20 of the platform abut against corresponding edges of the platforms of adjacent blades to form a complete annulus.

As can be seen in detail in FIGS. 3 and 4, the edge 20 of the platform is provided with an indentation, or cut-away hook portion 21 in its leading section. The hook portion 21 in fact comprises a cut-away which will leave an undercut projection or wall 22 which extends rearwardly, while to preserve the smooth aerodynamic surface of the platform, a thin frangible portion 23 is left covering the cut-away 22. It will be noted that the edge 20 is that edge of the platform adjacent to the convex flank of the aerofoil 17.

Operation of the invention is as follows: should the blade become detached from its rotor, in the most severe manner, it does so by a fracture taking place inbetween the platform and the root. Simple theory confirmed by tests have shown that the blade will move relative to the adjacent trailing blade radially outwards, rearwardly and circumferentially towards this blade.

This motion will usually bring the edge of the platform 20 into contact with the leading edge of the next adjacent blade in the row (this is the blade 25 in FIG. 5). This impact will cause the frangible portion 23 to break away leaving the blade engaging indentation or hook portion 22 uncovered, and this hook will then engage with the leading edge of the adjacent blade. It will be understood that engagement of this nature will prevent the blade from moving rearwardly to any significant degree and that its motion will then be constrained to be substantially radial. There is therefore a good expectation that the blade will impact on the cowling within the confines of a relatively narrow containment ring.

Although described above in terms of a hook or indentation formed as a depression in the otherwise straight edge of the blade platform, it should be noted that the indentation could be formed between the face of a projection from the platform and the straight edge of the remainder of the platform. FIG. 6 is a view similar to FIG. 3 but illustrating this alternative embodiment. It will be seen that the edge 20 in this case is formed into a projection at 26 which has a face or wall 27 forming with the remainder of the face 20 a step or indentation 28. In the illustrated version, the angle between the face or wall 27 and edge 20 is slightly less than a right angle, but it will be understood that acute angles generally could be used, and that the shape of the indentation 28 formed by the walls 22 and 27 could be rounded or otherwise varied to form a hook-like shape.

It will also be noted that this embodiment necessitates the provision of a corresponding depression in the abutting face 19 of the next adjacent blade platform to accommodate it.

It should be noted that there are a variety of ways in which the embodiment described above could be modified. Thus the precise shape of the hook 22 and the exact disposition shown in the drawings need not be followed, although this hook must be formed in or on the edge which is adjacent the convex flank of the blade. Again although the use of the frangible portion 23 is a simple way to preserve good aerodynamics while allowing the hook to operate, it would be possible to do away with this feature altogether or to replace it by a filler of soft or detachable material. It should also be noted that although described in conjunction with a single stage fan rotor the invention would be applicable to multi stage rotors which could be fans, compressors or turbines.

I claim:

1. A rotor assembly for a gas turbine engine comprising: a casing; a rotor mounted within said casing and having a plurality of rotor blades assembled thereon and defining at least one blade row; a containment ring carried by said casing outward of said at least one blade row, said containment ring being sufficiently strong to withstand impact of one of said blades; and each of said blades having an aerofoil portion with a convex flank and a concave flank, an inner platform having opposed edges arranged to abut against corresponding edges of adjacent platforms when said blades are assembled on said rotor, a root portion of reduced thickness relative to said platform at a point of attachment to said platform, and one of said edges lying adjacent to said convex flank of said aerofoil portion having an indentation formed thereon with one wall facing backwards at an angle less than 90° to said one edge whereby if said aerofoil portion and said platform becomes detached from said root portion and/or said rotor, motion of said aerofoil portion and said platform will be contained by engagement between said indentation on said platform and a leading edge of a next adjacent blade in said at least one blade row.

2. A rotor assembly as claimed in claim 1 wherein said indentation is defined by a projection from said edge, a junction between said projection and said edge defining said backward facing wall.

3. A rotor assembly as claimed in claim 1 and in which said indentation comprises a portion of said edge cut-away to form a hook.

4. A rotor assembly as claimed in claim 3 and in which said cut-away portion intersects said edge to form said rearwardly facing wall.

5. A rotor assembly as claimed in claim 3 and in which there is a frangible portion which covers the cut-away portion to maintain a smooth aerodynamic surface on that face of the platform from which the aerofoil portion projects.

6. A rotor assembly as claimed in claim 1 and in which said indentation is formed in the leading half of said one edge.

7. A rotor assembly as claimed in claim 1 in which said at least one blade row is a fan for the gas turbine engine.

* * * * *